United States Patent [19]

Fincham

[11] 4,139,734

[45] Feb. 13, 1979

[54] PIVOTED LOUDSPEAKER ENCLOSURE WITH VISUAL INDICATOR OF OPTIMUM LISTENING POSITION

[75] Inventor: Lawrence R. Fincham, Maidstone, England

[73] Assignee: KEF Electronics Limited, Kent, England

[21] Appl. No.: 882,226

[22] Filed: Feb. 28, 1978

[30] Foreign Application Priority Data

Apr. 13, 1977 [GB] United Kingdom ..... 15347/77

[51] Int. Cl.[2] ..... H04R 1/20

[52] U.S. Cl. ..... 179/1 E; 181/145

[58] Field of Search ..... 179/1 E, 1 GA

*Primary Examiner*—George G. Stellar

*Attorney, Agent, or Firm*—Lawrence E. Laubscher

[57] ABSTRACT

The present invention provides a loudspeaker comprising a plurality of enclosures each provided with a loudspeaker drive unit connected to an input, at least one of the enclosures being pivotally mounted with respect to another of the enclosures, said at least one enclosure being provided with means defining an aperture and a light emitting device, the means defining aperture being shaped and the light emitting device being positioned with respect to said aperture defining means whereby the device will be visible only when a listener is in the correct position.

5 Claims, 3 Drawing Figures

PIVOTED LOUDSPEAKER ENCLOSURE WITH VISUAL INDICATOR OF OPTIMUM LISTENING POSITION

The present invention relates to sound reproduction and in particular to loudspeakers.

For accurate reproduction of stereophonic sound the early sound arriving directly from the loudspeakers must maintain both the harmonic content and the relative time relationships of the original programme. In a practical multi-way speaker system, where high and low frequency drive units are provided, this requirement for accurate stereo reproduction will only be realised within a limited solid angle of dispersion. Where the units are mounted in a vertical line, the angle of dispersion will be wider horizontally than vertically. The area contained between the vertical and horizontal angles, for which the frequency response of the direct sound is maintained substantially constant, is called the 'listening window'.

An object of the present invention is to provide a visual indication for showing when a listener is in the optimum position for listening to a multi-way quality speaker system.

Features and advantages of the present invention will become apparent from the following description of an embodiment thereof when taken in conjunction with the accompanying drawings, in which.

Figure 1:
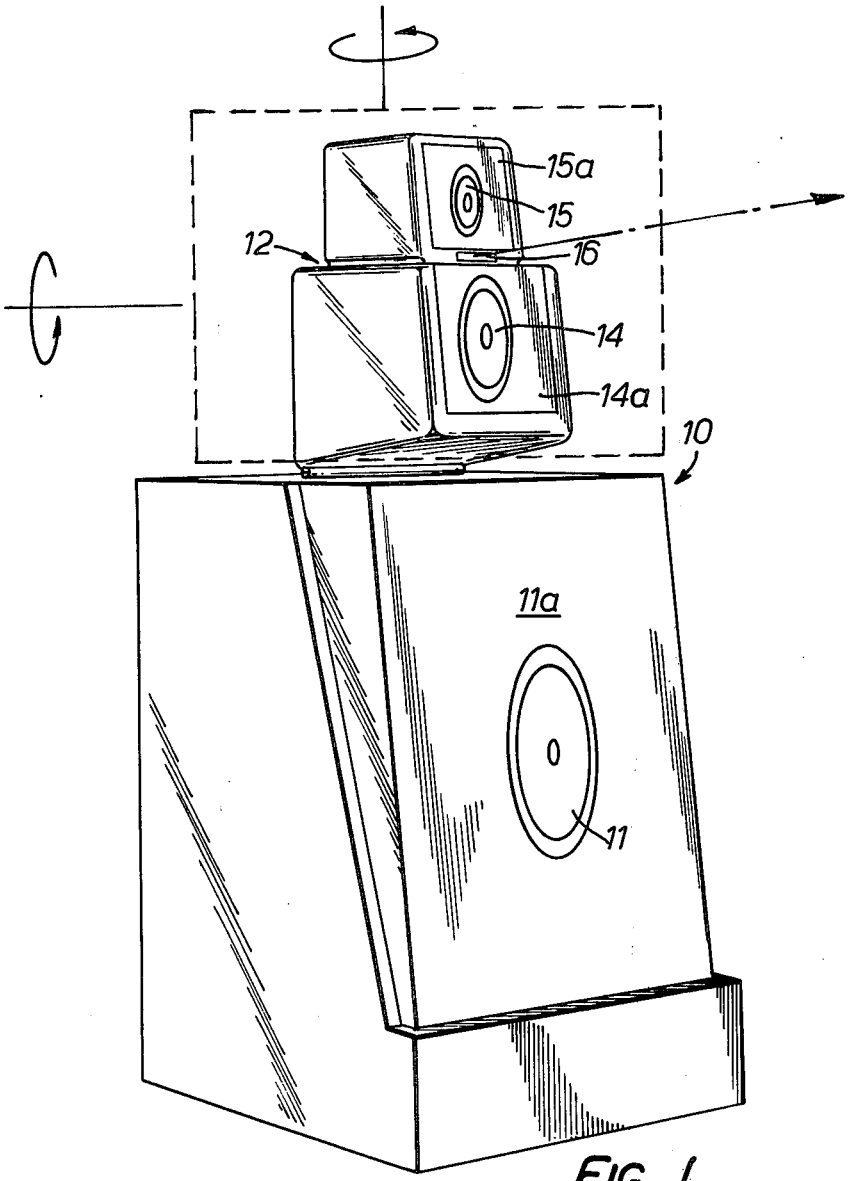
FIG. 1 shows a loudspeaker having a plurality of enclosures.
Figure 2:
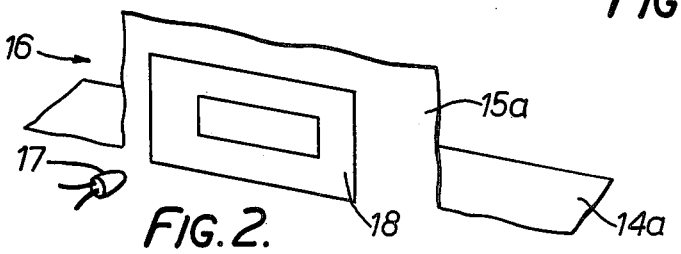
FIG. 2 shows a diagrammatic form of a listening window indicator.

FIG. 1 shows a loudspeaker 10 having three drive units mounted in two enclosures. The bass drive unit 11 is mounted in the enclosure 11*a* and the other enclosure 12 comprises two portions 14*a* and 15*a*, the enclosure portion 14*a* housing the midrange drive unit 14 and the enclosure portion 15*a* housing, the high frequency drive unit 15. A listening window indicator 16 is mounted between the midrange and high frequency drive units and is shown in more detail diagrammatically in FIG. 2. The enclosure portions 14*a* and 15*a* are shaped such that the drive units 14 and 15 are progressively stepped behind the vertical plane including the drive unit 11.

The indicator 16 comprises a light emitting device 17 which is masked by a specially apertured and positioned plate 18. The aperture in the plate is of a size and the plate positioned with respect to the device 17 such that the device is only visible when the listener is in the optimum listening area. The plate 18 is attached to the base of the enclosure portion 15*a*, FIG. 2 being an illustration from within the enclosure 12. The device 17 is preferably a light emitting diode (L.E.D.), the power for which is provided by directing a fraction of the programme power applied to the loudspeaker through a voltage doubling rectifier and smoothing circuit. This circuit is shown in detail in FIG. 3.

Referring again to FIG. 1, the enclosure 12 is mounted on the enclosure 11, vertically above the enclosure 11, such that it can be tilted about both vertical and horizontal axes with respect to the enclosure 11 in order to provide maximum freedom of choice of listening position while still remaining within the listening window.

Figure 3:
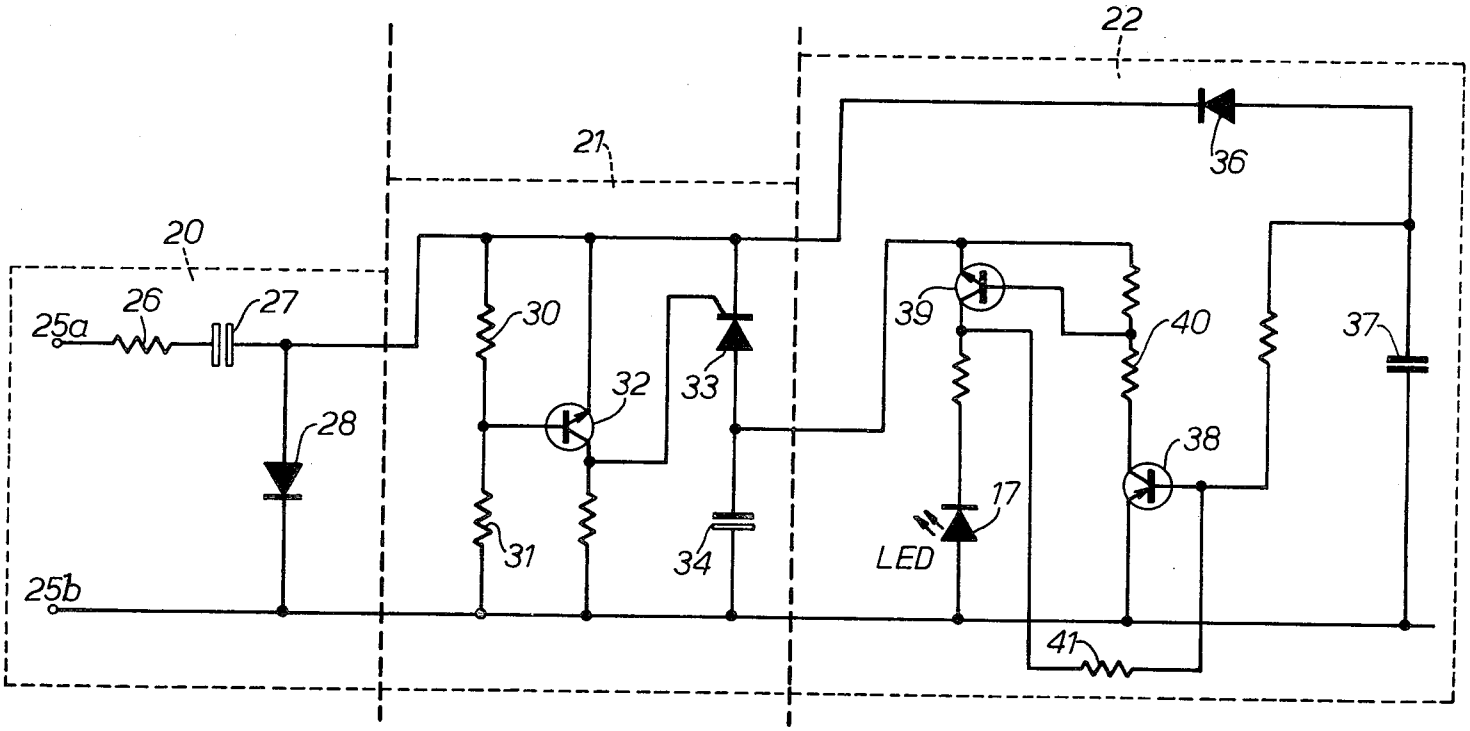
FIG. 3 shows a circuit diagram of a listening window indicator.

The circuit shown in FIG. 3 comprises a voltage doubler and rectifier circuit 20, a voltage regulator circuit 21 and an LED drive circuit 22. The different circuits are shown in broken lines. In more detail, the voltage doubler and rectifier circuit 21 comprises two input terminals 25*a*, 25*b* arranged to be connected to the leads connecting the loudspeaker to the amplifier. A current limiting resistor 26 is connected in series with the terminal 25*a* and one side of a capacitor 27. The other side of the capacitor 27 is connected to the anode of a diode 28 whose cathode is connected to the terminal 25*b*. The voltage across the diode 28 is approximately twice the voltage across the terminals 25*a*, 25*b* and is applied to the voltage regulator circuit 21.

The voltage regulator circuit comprises two resistors 30,31 connected in series across the output from the rectifier circuit 21. The junction between the resistors 30,31 is connected to a base connection of a transistor 32 whose collector is connected to the gate terminal of a thyristor 33. The anode of the thyristor 33 is connected to a capacitor 34 across which a 6 volt regulated output is obtained which is used to energise the components of the drive circuit 22. The cathode of the thyristor 33 is connected via a diode 36 to one side of a capacitor 37 which supplies the control voltage to a switch-on-and-lock circuit for the LED 17. The switch-on-and-lock circuit comprises two transistors 38 and 39, the base of transistor 38 being connected to the one side of capacitor 37 and the collector of the transistor 38 being connected by a resistor 40 to the base of the transistor 39. The LED 17 is connected in the collector circuit of the transistor 39 and feedback to maintain the LED lit is achieved by a resistor 41 connected between the collector of transistor 39 and the base of transistor 38.

It is possible to use the listening window indicator light emitting device as an overload indicator by including a series of resistors in the base circuit of the transistor 38 in the LED drive circuit. In this case, the listening window indicator would only be operative when setting up the loudspeakers initially and then a switch operated to switch out listening window facility in switch in a preselected number of resistors depending on the power output of the amplifier.

What is claimed is:

1. A loudspeaker comprising a plurality of enclosures each provided with a loudspeaker drive unit connected to an input, at least one of the enclosures being pivotally mounted with respect to another of the enclosures, said at least one enclosure being provided with means defining an aperture and a light emitting device, the means defining aperture being shaped and the light emitting device being positioned with respect to said aperture defining means whereby the device will be visible only when a listener is in the correct position.

2. A loudspeaker according to claim 1, wherein the light emitting device is connected in a circuit connected to said input of the loudspeaker.

3. A loudspeaker according to claim 1, wherein said at least one enclosure is pivotally mounted so as to be pivotable about a horizontal and a vertical axis.

4. A loudspeaker according to claim 1, wherein said at least one enclosure comprises two portions, one provided with a mid-range drive unit and the other with a high frequency drive unit.

5. A loudspeaker according to claim 4, wherein the mid-range and high frequency drive units are staggered with respect to the drive unit in said another of the enclosures.

* * * * *